US008170262B1

(12) United States Patent
Liu

(10) Patent No.: US 8,170,262 B1
(45) Date of Patent: May 1, 2012

(54) WIRELESS AIR TUBE HEADSET

(76) Inventor: Frank Kung Fu Liu, Diamond Bar, CA (US)

( * ) Notice: Subject to any disclaimer, the term of this patent is extended or adjusted under 35 U.S.C. 154(b) by 403 days.

(21) Appl. No.: 12/423,915

(22) Filed: Apr. 15, 2009

(51) Int. Cl.
*H04R 25/02* (2006.01)

(52) U.S. Cl. ..... 381/382

(58) Field of Classification Search ..... 381/382
See application file for complete search history.

(56) References Cited

U.S. PATENT DOCUMENTS

| | | | | | |
|---|---|---|---|---|---|
| 299,300 | A * | 5/1884 | Warth | 379/430 |
| 1,321,265 | A * | 11/1919 | Wagne | 381/338 |
| 2,586,644 | A * | 2/1952 | Gilbert | 381/382 |
| 3,667,569 | A * | 6/1972 | Mackey et al. | 181/135 |
| 4,090,042 | A * | 5/1978 | Larkin | 379/430 |
| 4,261,432 | A * | 4/1981 | Gunterman | 181/137 |
| 4,325,453 | A * | 4/1982 | Moussette | 181/135 |
| 4,347,911 | A * | 9/1982 | Bertagna et al. | 181/130 |
| 4,588,868 | A * | 5/1986 | Bertagna et al. | 381/382 |
| 4,683,587 | A * | 7/1987 | Silverman | 381/311 |
| 4,864,610 | A * | 9/1989 | Stevens | 379/431 |
| 5,251,326 | A * | 10/1993 | Silverman | 455/40 |
| 5,528,689 | A * | 6/1996 | Chan | 379/430 |
| 5,590,417 | A * | 12/1996 | Rydbeck | 455/575.2 |
| 5,613,222 | A * | 3/1997 | Guenther | 455/575.2 |
| 5,761,319 | A * | 6/1998 | Dar et al. | 381/330 |
| 5,987,146 | A * | 11/1999 | Pluvinage et al. | 381/328 |
| 6,021,207 | A * | 2/2000 | Puthuff et al. | 381/330 |
| 6,181,801 | B1 * | 1/2001 | Puthuff et al. | 381/380 |
| 6,377,824 | B1 * | 4/2002 | Ingbir et al. | 455/575.1 |
| 6,438,245 | B1 * | 8/2002 | Taenzer et al. | 381/330 |
| 6,445,799 | B1 * | 9/2002 | Taenzer et al. | 381/71.6 |
| 6,631,279 | B2 * | 10/2003 | Rivera | 455/575.2 |
| 6,825,810 | B2 * | 11/2004 | Ragner et al. | 343/700 MS |
| 6,920,228 | B2 * | 7/2005 | Redmer et al. | 381/370 |
| 6,961,440 | B1 * | 11/2005 | Schlaegel | 381/382 |
| 7,233,676 | B2 * | 6/2007 | Bayer | 381/328 |
| 7,813,762 | B2 * | 10/2010 | Sanguino et al. | 455/557 |
| 8,086,288 | B2 * | 12/2011 | Klein | 455/575.2 |
| 8,090,134 | B2 * | 1/2012 | Takigawa et al. | 381/373 |
| 2002/0096391 | A1 * | 7/2002 | Smith et al. | 181/135 |
| 2003/0133585 | A1 * | 7/2003 | Cheung | 381/382 |
| 2004/0125979 | A1 * | 7/2004 | Elidan et al. | 381/382 |
| 2004/0185915 | A1 * | 9/2004 | Ihara et al. | 455/569.1 |
| 2007/0206829 | A1 * | 9/2007 | Weinans et al. | 381/370 |
| 2007/0230727 | A1 * | 10/2007 | Sanguino et al. | 381/315 |
| 2010/0061582 | A1 * | 3/2010 | Takigawa et al. | 381/380 |
| 2011/0081034 | A1 * | 4/2011 | Tung et al. | 381/332 |

* cited by examiner

*Primary Examiner* — Jeffrey Donels
*Assistant Examiner* — Robert W Horn
(74) *Attorney, Agent, or Firm* — Dan Brown Law Office; Daniel R. Brown

(57) ABSTRACT

A wireless air tube headset that includes a wireless transceiver operating in a radio frequency band, which wireless receives audio signals. The headset includes an acoustic chamber with an acoustic port through to the exterior thereof, and an acoustic transducer that is electrically coupled to the transceiver, and that operates to generate acoustic signals. The acoustic transducer is aligned with the acoustic chamber to emit the acoustic signals through the acoustic port. There is an acoustic isolator disposed to attenuate extraneous acoustic signals emitted from the acoustic transducer and also to attenuate ambient noise entry into the acoustic chamber. An acoustic conduit is formed from an electrically non-conductive material, and has a first opening engaged with the acoustic port and a second opening engaged with an acoustic coupler, which has a first earpiece engagement means. An earpiece is engaged to the first earpiece engagement means, and thereby forms an electrically non-conductive acoustic path from the acoustic transducer to the earpiece. The acoustic path has a length to enable displacement of the transceiver and the acoustic transducer from the earpiece at a distance sufficient to yield at least a six decibel radio signal propagation power loss at the radio frequency band.

23 Claims, 8 Drawing Sheets

Auricle Structure

Ear Bud
(Into Canal)

Ear Phone
(Into Concha)

Ear Insert
(Engages Antihelix & Tagus)

Ear Cup
(Supra Aural)

Ear Hook
(Wraps Root)

WIRELESS AIR TUBE HEADSET

BACKGROUND OF THE INVENTION

1. Field of the Invention

The present invention relates to head worn audio headsets. More particularly, the present invention relates to radio wireless headsets that employ an air tube acoustically coupled earpiece.

2. Description of the Related Art

Wireless earphones and headset are known. These include monaural and stereo listen-only headsets and headsets used in telephony and radiotelephony that include a microphone for enabling duplex communications. A common application for wireless headsets is use in conjunction with a cellular telephone. A cellular telephone is carried by a user, and is used for interconnection with a cellular telephone network. The cellular telephone additionally includes a separate wireless transceiver, commonly a Bluetooth compliant transceiver. The Bluetooth transceiver in the cellular telephone wirelessly communicates with a compact, head worn wireless headset. These are commonly referred to as Bluetooth headsets. The Bluetooth headset itself comprises a compact Bluetooth transceiver, a battery, an earphone, and limited user interface components. In operation, the cellular telephone functions to engage in telephone calls through the cellular network, and the Bluetooth headset enables the user to listen and speak in a hands free mode of operation without the need for a wire or cable between the cellular telephone and the headset. The Bluetooth transceivers in the cellular telephone and in the wireless headset provide the needed communications link therebetween.

Many users of wireless device and certain medical professionals have indicated a concern in regards to the extended use of wireless devices in the vicinity of the human brain. The concern relates to the possibility of radiational damage cause by the absorption of radio energy in the brain tissues. In fact, a reason that cellular telephone users employ headsets is the understanding that the cellular radio, being positioned a distance away from the user's brain, will result in lower radiated power levels, and thus lower radiation risk. However, in the case of a wired headset, the radio energy originating in the radio transceiver excites the audio conductors coupled to the headset, and results in radio energy being present in the acoustic driver, or speaker, as well as the microphone in the headset. Thus, the user is effectively coupling the radio energy to a position directly adjacent to their ear and brain. Other users employ the aforementioned Bluetooth wireless headsets, understanding that the wireless headset breaks the conductive link for radio energy from the cellular telephone, thereby preventing the cellular transceiver's energy from significantly coupling into the brain tissue.

Bluetooth transceivers operating in the 2.4 GHz ISM band, which is a frequency band known to be absorbed into brain tissue. Even though the transmitter power levels of Bluetooth transceivers are relatively low as compared to cellular transceiver power levels, the fact that the Bluetooth headset transceivers are worn directly adjacent to the user's ear and brain, creates the worst case scenario for radiational damage exposure, particularly given the absorptive nature of the 2.4 GHz operating band in brain tissue. Thus, users who chose to use a Bluetooth headset to avoid cellular radiation exposure risk, are actually substituting that exposure risk for another risk. Thus, it can be appreciated that there is a need in the art to reduce the risk of radiation exposure to users of wireless headset devices.

SUMMARY OF THE INVENTION

The need in the art is addressed by the apparatus of the present invention. The present invention teachers a wireless air tube headset that includes a wireless transceiver operating in a radio frequency band, which wireless receives audio signals. The headset includes an acoustic chamber with an acoustic port through to the exterior thereof, and an acoustic transducer that is electrically coupled to the transceiver, and that operates to generate acoustic signals. The acoustic transducer is aligned with the acoustic chamber to emit the acoustic signals through the acoustic port. There is an acoustic isolator disposed to attenuate extraneous acoustic signals emitted from the acoustic transducer and also to attenuate ambient noise entry into the acoustic chamber. An acoustic conduit is formed from an electrically non-conductive material, and has a first opening engaged with the acoustic port and a second opening engaged with an acoustic coupler, which has a first earpiece engagement means. An earpiece is engaged to the first earpiece engagement means, and thereby forms an electrically non-conductive acoustic path from the acoustic transducer to the earpiece. The acoustic path has a length to enable displacement of the transceiver and the acoustic transducer from the earpiece at a distance sufficient to yield at least a six decibel radio signal propagation power loss at the radio frequency band.

In a specific embodiment of the foregoing apparatus, the acoustic transducer includes a frame that supports a vibrating element, and the frame is sealably engaged with the acoustic chamber, thereby forming a closed acoustic chamber about the acoustic port. In another embodiment, the acoustic isolator includes a sealed cover about the portion of the acoustic transducer that is exterior to the closed acoustic chamber.

In a specific embodiment, the foregoing apparatus further includes a housing disposed about the sound chamber where the acoustic port is accessible from the exterior of the housing, and the transceiver is disposed within the housing. In a refinement to this embodiment, the apparatus also includes an antenna electrically coupled to the transceiver and disposed within the housing, and a battery disposed within the housing for powering the apparatus, and plural user interface controls electrically coupled to the transceiver disposed about the housing. In another refinement, this embodiment further includes a microphone electrically coupled to the transceiver and disposed within the housing, and the acoustic isolator includes an elastomeric shock mount disposed to isolate the microphone from the acoustic signals.

In another refinement to the housing embodiment of the headset, the apparatus further includes a vibrator disposed within the housing and electrically coupled to the transceiver, and adapted to produce a vibrating alert indicative of the availability of acoustic signals. In another refinement, where the apparatus is adapted for support from a person, a person's clothing, or a personal accessory, the apparatus further includes a support member disposed on the exterior of the housing for supporting the weight of the apparatus. In a refinement to this embodiment, the support member is selected from a clip, a spring loaded clip, a lanyard ring, a pin, a friction attachment, and a hook. In a particular refinement, the support member is adapted to engage the frame of a pair of eyeglasses.

In another refinement to the housing embodiment of the headset, the apparatus further includes an acoustic conduit storage member disposed on the exterior of the housing that is adapted to engage the acoustic conduit as it is wrapped there about. In a refinement to this embodiment, it further includes an earpiece engagement member adapted to engage the earpiece while the acoustic conduit is wrapped about the acoustic conduit storage member.

In a specific embodiment of the foregoing apparatus, the acoustic conduit is a flexible tube. In another specific embodiment, the acoustic conduit is a rigid pipe. In another embodiment, the acoustic conduit is adapted to support the weight of the apparatus from the earpiece. In another embodiment, the acoustic conduit is formed into the shape of an ear hook for supporting the weight of the apparatus.

In a specific embodiment of the foregoing apparatus, the acoustic port is sealably coupled to the acoustic conduit, and the acoustic conduit is sealably coupled to the acoustic coupler. In another specific embodiment, the first opening of the acoustic conduit is coupled to the acoustic port with a removable coupling. In a refinement to this embodiment, the removable coupling employs a connection selected from a threaded engagement, a bayonet engagement, a compression engagement, and a friction engagement.

In a specific embodiment of the foregoing apparatus the acoustic coupler is engaged with the second opening of the acoustic conduit with a removable coupling. In a refinement to this embodiment, the removable coupling employs a connection selected from a threaded engagement, a bayonet engagement, a compression engagement, and a friction engagement.

In a specific embodiment of the foregoing apparatus, the first engagement means of the acoustic coupler is configured as an acoustic opening adapted to engage an ear bud earpiece, and the headset further includes a second earpiece engagement means disposed about the earpiece engagement means that is adapted to engage an ear cup earpiece. In a refinement to this embodiment, the second earpiece engagement means employs a connection selected from a threaded engagement, a bayonet engagement, a compression engagement, and a friction engagement. In another specific embodiment, the first earpiece engagement means is adapted to engage alternate earpiece types selected from an ear bud, an ear phone, an ear insert, and an ear cup. In another embodiment, the headset further includes an ear hook coupled to support the earpiece and the acoustic coupler.

DESCRIPTION OF THE INVENTION

Figure 1:
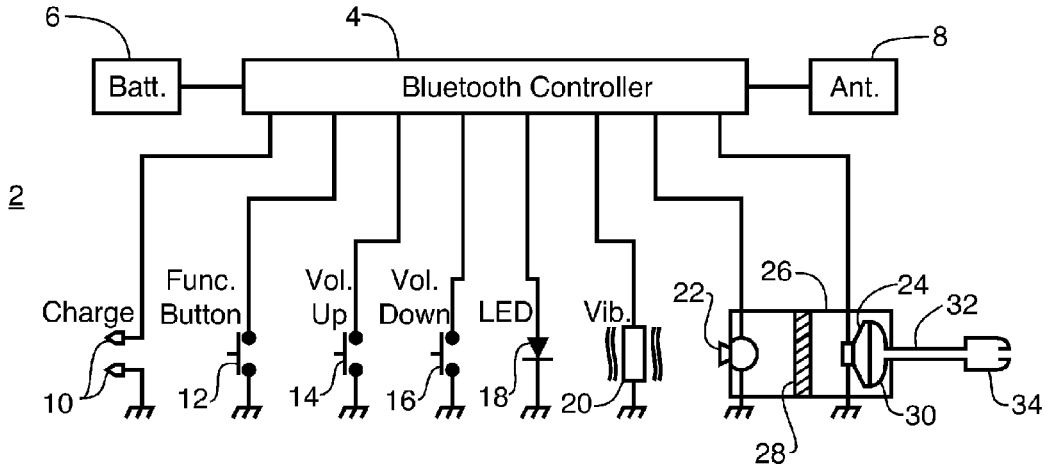
FIG. 1 is a functional block diagram of a wireless air tube headset according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of components to form various apparatus and systems or combinations of steps to accomplish various methods. Accordingly, the apparatus components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The illustrative embodiments of the present invention are directed to Bluetooth compliant wireless headsets. It is understood that this is an exemplary radio environment and that other frequency bands, radio protocols, information modulations schemes, and radio signal power levels are applicable to this invention, and can similarly benefit from the teachings herein. The Bluetooth protocol is well documented and the specifics of the protocol will not be presented in this disclosure, except to the extend it is useful in understanding the teachings of these inventions.

The Bluetooth protocol in the United States operates in the 2.4 GHz ISM band. The protocol specification brackets transmitter radio emissions into three categories, which are; Class 1 at 100 mW (20 dBm), Class 2 at 2.5 mW (4 dBm), and Class 3 at 1 mW (0 dBm) maximum power. Device power level selection determines effective radio range, and other operating parameters of the Bluetooth compliant device. At the 2.4 GHz band, radiated power level attenuates rapidly as an inverse function of distance. The calculations are known to those skilled in the art. Radio signal level power level losses based on an isotropic radiator in free space as a function of distance are approximated in the following table:

TABLE

| Distance | Attenuation |
|---|---|
| 2 meter | −46 dB |
| 1 meter | −40 db |
| 50 cm | −34 dB |
| 20 cm | −26 dB |
| 10 cm | −20 dB |
| 5 cm | −14 dB |
| 2 cm | −6 dB |

With respect to the emissions from a wireless headset, the emissions characteristics are more difficult to quantify. In addition to the antenna element of the wireless headset, the ungrounded nature of the circuit causes the entire conductive circuit to resonate in the operating band. Thus, the entire circuit behaves as a radiating element. This includes the antenna, the radio transceiver and digital circuitry, the power circuitry, as well as the audio circuits to the earpiece transducer and the microphone. However, the free spaces losses to radiated energy are proportional to the forgoing table, and the radiated power levels drop as the circuitry is displaced from a given reference point. In the present invention, displacement of the circuitry from the user's brain is the objective, while still preserving high quality audio performance and a desirable bundle of product features. This goal is achieved in the present invention through use of an air tube acoustic coupling between the acoustic transducer and the earpiece, together with displaced position of the microphone, thereby providing sufficient displacement to achieve at least 6 dB attenuation of the radiated power levels.

Reference is directed to FIG. 1, which is a functional block diagram of a wireless air tube headset according to an illustrative embodiment of the present invention. The central circuit is a commercial Bluetooth controller 4, which includes a radio transceiver in the 2.4 GHz band, a microcontroller, power management, and input/output circuits utilized to enable a set of user interface controls. Bluetooth controllers are commercially available and are known to those skilled in the art. The circuit is powered by a rechargeable battery 6 that is charged through charge contacts 10 while the headset rests in a charging cradle (not shown) as are known to those skilled in the art. An antenna element 8 is included in the circuit, which provides the access point to the Bluetooth air interface. The circuit includes a function button 12 that enables control of the various circuit features using certain preprogrammed actuation sequences. Earpiece speaker volume is controlled with a pair of buttons, the volume up 14 and volume down 16 actuators. A light emitting diode 18 is used to indicate power, call progress events, as well as confirmation of user interface button actuations. One embodiment of the present invention includes a tactile vibrator 20, which is activated upon receipt of an incoming telephone call, or other audio content, to alert the user in the event that the earpiece is not engaged in the user's ear, such that the user cannot hear a conventional ring tone, or other alert tone.

The Bluetooth headset circuits of the illustrative embodiment in FIG. 1 include a housing 26 that contains a microphone 22 and an acoustic transducer 14. In the illustrative embodiment the microphone 22 is a tiny electret condenser microphone exposed though a microphone port opening in the housing. The acoustic transducer 24 is a tiny loudspeaker. The acoustic transducer is coupled to an acoustic chamber 30 that gathers the acoustic signals and directs them through an acoustic port in the acoustic chamber 30 to an electrically non-conductive acoustic conduit 32 that effectively displaces all of the radio energy radiating circuits away from the earpiece 34. The acoustic chamber 30 also serves to concentrate the acoustic energy produced by the acoustic transducer 24 to yield an efficient transfer into the acoustic conduit 32. Audio quality and acoustic performance are enhanced through use of certain acoustic isolation means 28. Isolation occurs between the microphone acoustic signals, the acoustic transducer audio signals, and other ambient audio signals and noise that might otherwise be coupled into the acoustic environment. The isolation means 28 will be more fully discussed hereinafter. Note that other circuit components of FIG. 1 are typically positioned into the interior of the housing 26.

Figure 2:
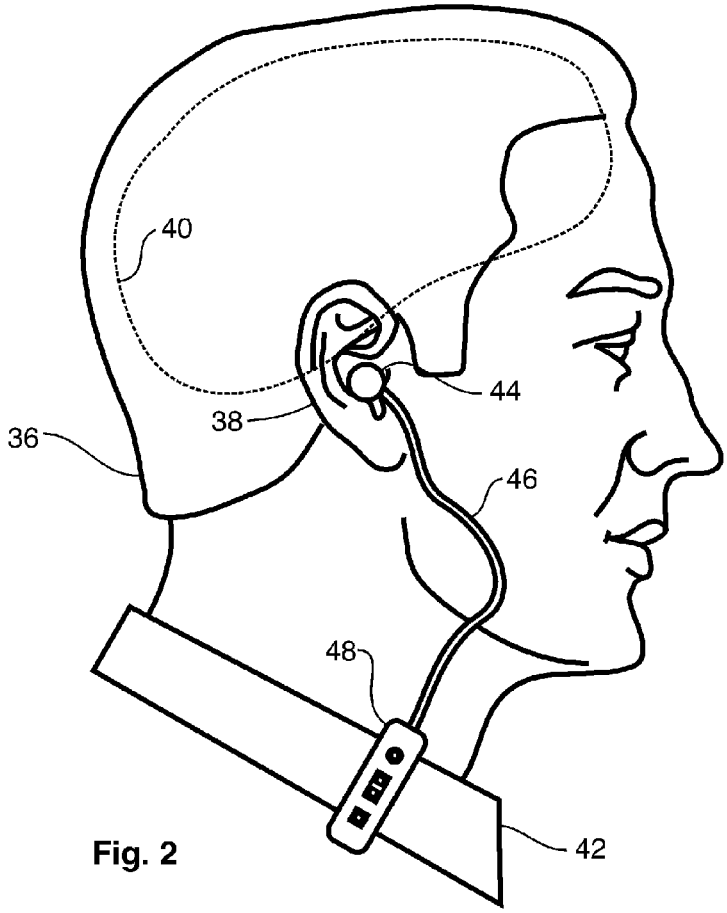
FIG. 2 is a drawing of a head worn wireless air tube headset according to an illustrative embodiment of the present invention.

Reference is directed to FIG. 2, which is a drawing of a head worn wireless air tube headset according to an illustrative embodiment of the present invention. A profile line drawing view of a human head 36 illustrates the general positional relationship of the auricle portion of the ear 38 (commonly referred to as the outer ear) and the sensitive brain tissue 40. As noted hereinbefore, the object of the air tube wireless headset is to displace the radiating circuit components away from the brain 40, which is, to a large extent, synonymous with displacing it away from the ear 38, provided that the displacement from the ear isn't upward or rearward. The conductive and radiating wireless headset circuitry is enclosed in a housing 48 that is clipped to the collar 42 of the user's shirt in this embodiment. An electrically non-conductive acoustic conduit 46 in the form of a flexible plastic tube couples the acoustic signals to an earpiece 44 that is held adjacent to the user's ear 38 in this embodiment. Thusly, a displacement of the radiating circuitry from the user's brain on the order of approximately 10-to-20 cm is achieved, which results in a radiated power level reduction in the 20-to-26 decibel range.

Figure 3:
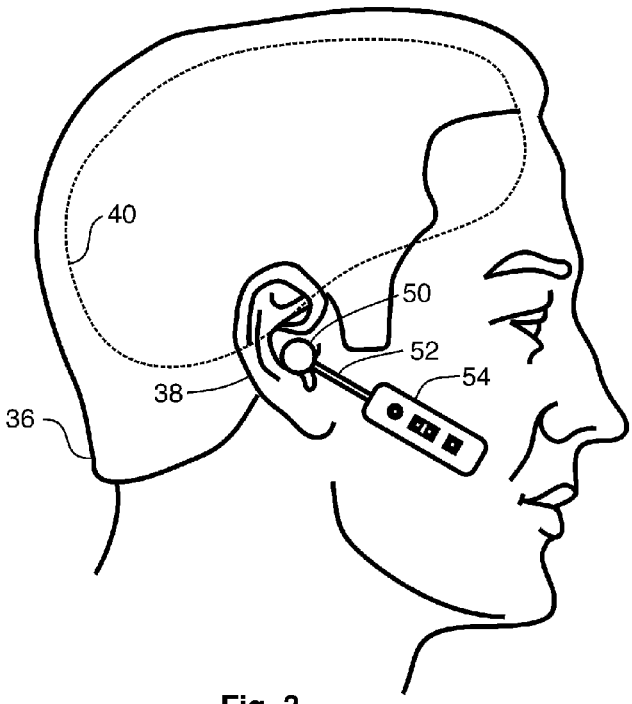
FIG. 3 is a drawing of a head worn wireless air tube headset according to an illustrative embodiment of the present invention.

Reference is directed to FIG. 3, which is a drawing of a head worn wireless air tube headset according to an illustrative embodiment of the present invention. In this illustrative embodiment, the earpiece 50 is an ear bud that engages the ear canal to support the Bluetooth circuitry using a non-conductive rigid pipe acoustic conduit 52. The length of the rigid pipe 52 can be selected to yield a displaced length in the range of 5-to-10 cm, which results in a radiated power level reduction in the 14-to-20 decibel range.

Figure 4:
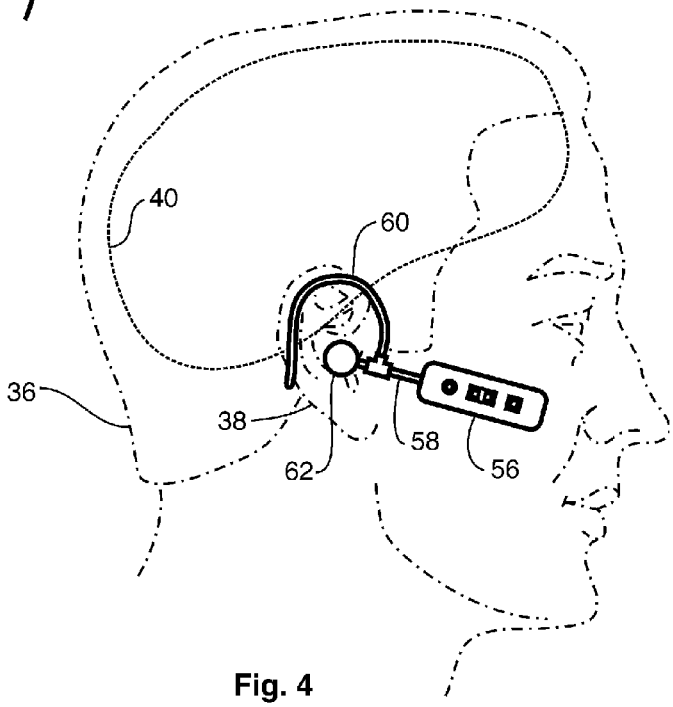
FIG. 4 is a drawing of a head worn wireless air tube headset according to an illustrative embodiment of the present invention.

Reference is directed to FIG. 4, which is a drawing of a head worn wireless air tube headset according to an illustrative embodiment of the present invention. In this illustrative embodiment, the earpiece 62 is held adjacent to the ear 38 using an ear hook 60 for support of the apparatus. The ear hook 60 engages the outer portion of the ear 38 and is coupled to the rigid pipe acoustic conduit 58 that is further coupled to the circuitry housing 56 of the apparatus. The ear hook 60 is also non-metallic and can be coupled to the acoustic conduit 58 as illustrated, or to the earpiece 62, or to the circuitry housing 56. The length of the non-metallic rigid pipe acoustic conduit 58 can be selected to yield a displaced length in the range of 5-to-10 cm, which results in a radiated power level reduction in the 14-to-20 decibel range.

Figure 5:
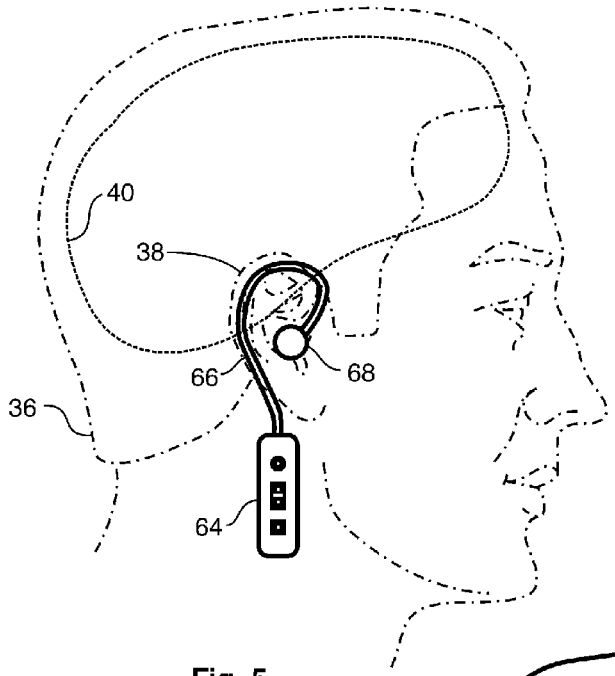
FIG. 5 is a drawing of a head worn wireless air tube headset according to an illustrative embodiment of the present invention.

Reference is directed to FIG. 5, which is a drawing of a head worn wireless air tube headset according to an illustrative embodiment of the present invention. In this embodiment, the earpiece 68 is held adjacent to the user's ear 38 with an ear hook 66 that also serves as the acoustic conduit coupled to the circuitry housing 64. Various types of earpiece designs can be employed in this embodiment since the primary support is achieved using the ear hook 66. The non-metallic acoustic tube serves to provide the isolation and radio energy displacement. The length of the acoustic conduit 66 can be selected to yield a displaced length in the range of 5-to-20 cm, which results in a radiated power level reduction in the 14-to-26 decibel range.

Figure 6:
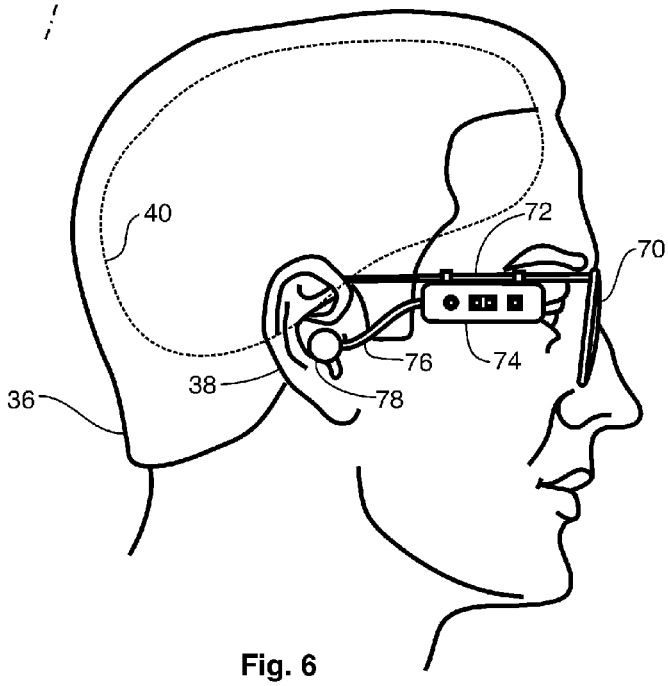
FIG. 6 is a drawing of a head worn wireless air tube headset according to an illustrative embodiment of the present invention.

Reference is directed to FIG. 6, which is a drawing of a head worn wireless air tube headset according to an illustrative embodiment of the present invention. In this embodiment, a pair of eyeglasses 70 is advantageously employed to support the circuitry housing 74 of the apparatus. The housing 74 is supported from the bow 72 of the eyeglasses 70 using a suitable clip. A non-metallic tube 76 is used from the acoustic conduit, which is coupled to an earpiece 78. Note that the displacement from the brain 40 appears to be slightly less than when compared to the previous embodiments. However, the lateral displacement is enhanced since the bow 72 of the eyeglasses 70 is also displaced away from the head 36. The total displacement from the brain will be greater than 2 cm to a distance greater than 5 cm, depending of the arrangement, which results in a radiated power level reduction in the range of more than 6 decibels to somewhat more than 14 decibels.

Figure 7:
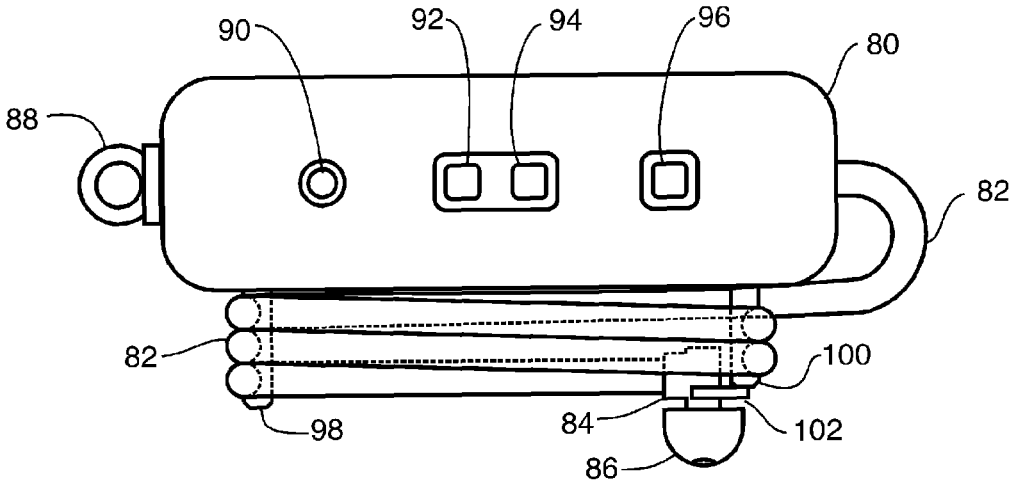
FIG. 7 is a drawing of a wireless air tube headset according to an illustrative embodiment of the present invention.

Reference is directed to FIG. 7, which is a drawing of a wireless air tube headset according to an illustrative embodiment of the present invention. This embodiment illustrates certain novel feature of the invention. The circuitry housing 80 presents the aforementioned function button 96 and the volume up and volume down button 94, 92. In addition, the LED indicator lamp 90 is presented. Other user interface configurations are also possible, as will be appreciated by those skilled in the art. A lanyard ring 88 is provided to further enable support, retention and transportation of the apparatus. Since the acoustic conduit 82 may have considerable length in some embodiments, conduit retention means 98, 100 are provided. The conduit retention means 98, 100 enable the coiled wrapping of the acoustic conduit 82 there about. The acoustic conduit 82 is terminated with an acoustic coupling 84 that engages the earpiece 86 to the acoustic conduit 82, and orients the earpiece 86 for comfortable use while wearing in the ear. An acoustic coupling engagement means 102 is provided so that the acoustic conduit is retained from unwrapping from the conduit retention means 100, 102. In certain embodiments, the acoustic coupling retention means 102 orients the earpiece 86 such that the apparatus can be worn and function while the acoustic conduit 82 is wrapped.

Figure 8:
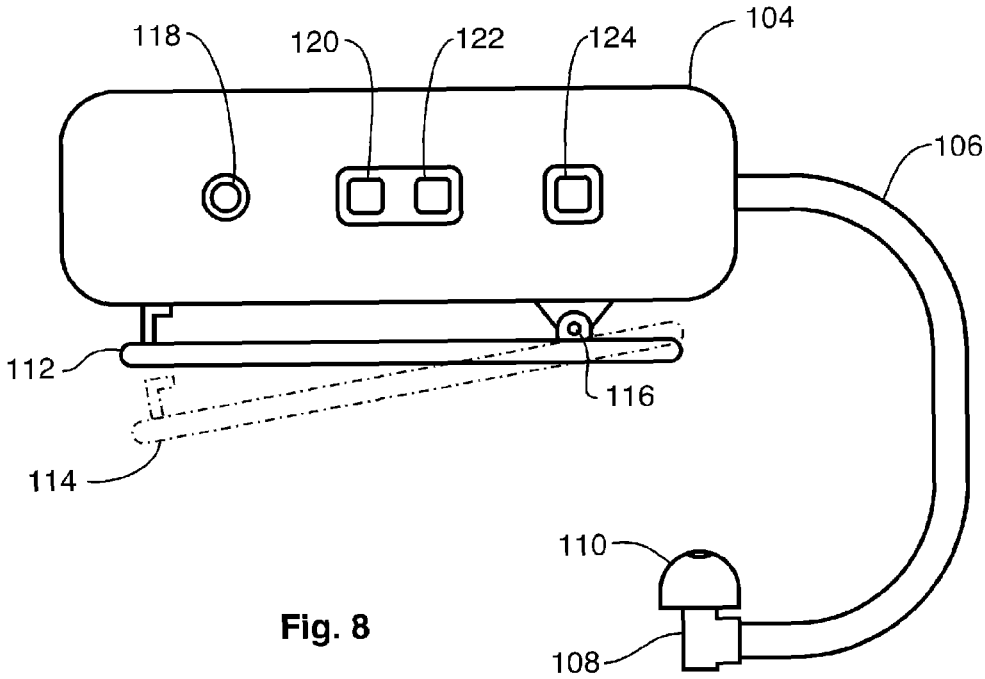
FIG. 8 is a drawing of a wireless air tube headset according to an illustrative embodiment of the present invention.

Reference is directed to FIG. 8, which is a drawing of a wireless air tube headset according to an illustrative embodiment of the present invention. This embodiment illustrates certain novel features of the invention. The circuitry housing 104 presents the aforementioned function button 124 and the volume up and volume down button 122, 120. In addition, the LED indicator lamp 118 is presented. Other user interface configurations are also possible, as will be appreciated by those skilled in the art. The acoustic conduit 106 extends from the circuitry housing 104 and is coupled to the earpiece 110 with a right-angled acoustic coupler 108. The earpiece 110 is removably engaged with the acoustic coupler 108, which enables the user to select from among plural earpiece sizes and types which will be more fully described hereinafter. The illustrative embodiment of FIG. 8 also includes a clip 112 that is coupled to the housing 104 with a spring hinge 116. The user can urge the clip 112 to a open position 114, thereby enabling attachment to clothing or other articles.

Figure 9:
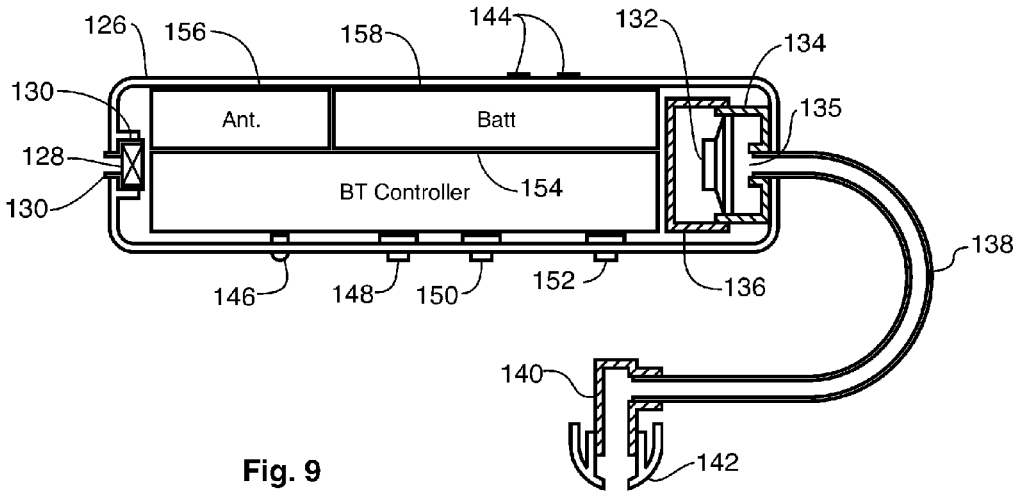
FIG. 9 is a section drawing of a wireless air tube headset according to an illustrative embodiment of the present invention.

Reference is directed to FIG. 9, which is a section drawing of a wireless air tube headset according to an illustrative embodiment of the present invention. The structure represents one structural embodiment. Those skilled in the art will appreciate that the shape and proportions can be adapted to suite various industrial design and marketing criteria. The circuit housing 126 is a molded thermoplastic structure that encloses the Bluetooth controller 154, the rechargeable battery 158 and a 2.4 GHz antenna 156. Battery charging terminals 144 are presented on the exterior of the housing 126 to facilitate charging of the battery 158. The function button 152, the volume-up button 150, the volume-down button 148, and the LED lamp 146 are also presented on the exterior of the housing 126. An electret condenser microphone 128 is retained in the housing adjacent to an opening to allow audio signals to reach the microphone 128 diaphragm. An isolation means 130, in the form of a resilient elastomeric shock mount isolates other audio signals, including handling noise and speaker acoustic signals from reaching the sensitive microphone element 128. The received audio signals are reproduced by an acoustic transducer 132.

The acoustic transducer 132 is a tiny loudspeaker having a vibrating element disposed within a frame. The acoustic transducer 132 frame is sealably engaged with an acoustic chamber 134 having an acoustic port 135 coupled to the exterior of the housing 126. A second isolation means 136 encloses the opposite side of the acoustic transducer 132 from the acoustic chamber side. The second isolation means 136 is a molded cap in the illustrative embodiment, but other acoustic signal blocking materials and shapes could also be utilized. A sound insulating material can also be added within the housing 126. A non-conducive acoustic conduit 138 is engaged to the acoustic port 135 at a first end. In the illustrative embodiment, the acoustic conduit 138 may be a flexible plastic or rubber tube, a rigid thermoplastic pipe, or other suitable non-conductive acoustic conduit, as will be appreciated by those skilled in the art. At the second end of the acoustic conduit 138 is an acoustic coupler 140 that serves to receive the second end of the acoustic conduit 138 and an earpiece 142. In the illustrative embodiment, the acoustic coupler 140 is formed at a right angle to facility routing of the acoustic conduit 138 from the user's ear during use. The acoustic coupler 140 can also serve as the support point for an ear hook or other body worn support structure. The earpiece 142 is removably coupled to the acoustic coupler 140, thereby enabling selection and attachment of a variety of sizes and types of earpieces. Thusly, the acoustic signals produced by the acoustic transducer 132 are contained by the acoustic chamber 134 and directed through the acoustic port 135 into the acoustic conduit 138, then directed to the acoustic coupler 140, and finally to the earpiece 142, which is engaged with the users ear.

Figure 10:
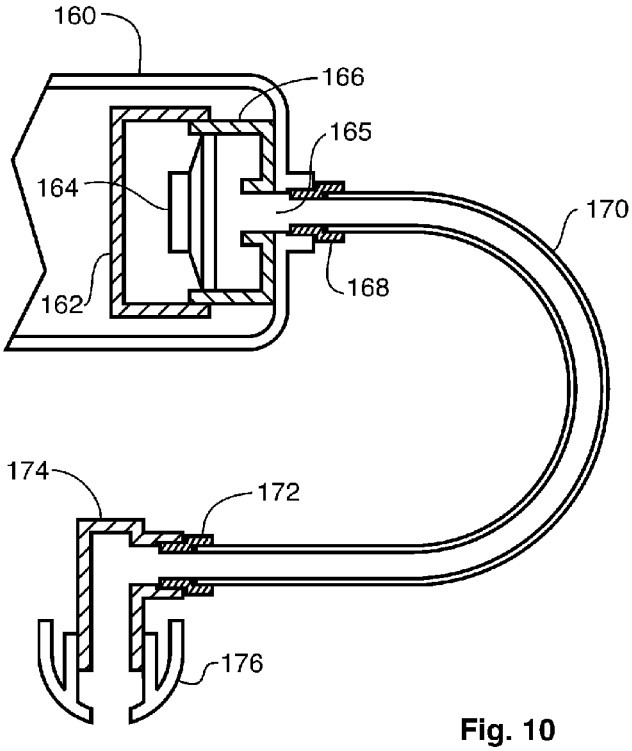
FIG. 10 is a partial section drawing of a wireless air tube headset according to an illustrative embodiment of the present invention.

Reference is directed to FIG. 10, which is a partial section drawing of a wireless air tube headset according to an illustrative embodiment of the present invention. This embodiment illustrates a selectively connectable acoustic conduit 170. This embodiment enables the user to make changes and adjustments to the apparatus, such as changing the length of the conduit, changing the type of acoustic coupler and earpiece, and changing between flexible and rigid acoustic conduits, and so forth. The partial section drawing of FIG. 10 illustrates the housing 166 having the acoustic chamber 166 with the acoustic transducer 164 disposed therein. The acoustic port 165 couples the acoustic chamber 166 to the exterior of the housing 160. An isolation means 162 encloses the back side of the acoustic transducer 164. A removable coupling 168 is attached to a first end of the acoustic conduit 170, and removably engages the acoustic port 165. The attachment between the removable coupler 168 and the acoustic port 165 can be by threaded engagement, bayonet coupling, friction fit, compression fit, or other sealable engagement means as are known to those skilled in the art. At the second end of the acoustic conduit 170, there is a second removable coupler 172 that removably engages the acoustic coupler 174. The second removable coupler can also be by threaded engagement, bayonet coupling, friction fit, compression fit, or other sealable engagement means as are known to those skilled in the art. The earpiece 176 removably engages the acoustic coupler 174.

Figure 11:
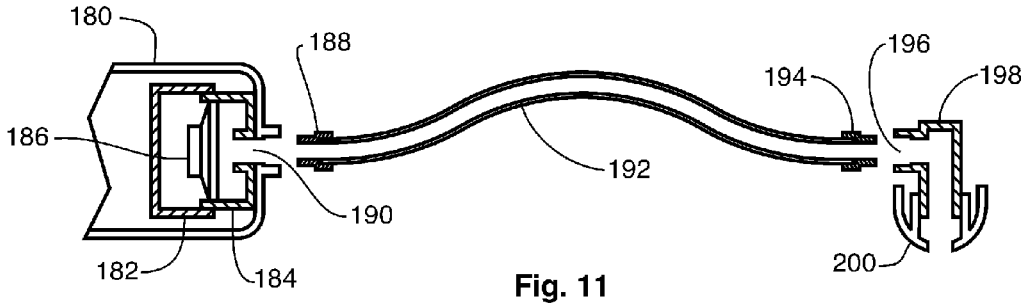
FIG. 11 is a partial section drawing of a wireless air tube headset according to an illustrative embodiment of the present invention.

Reference is directed to FIG. 11, which is a partial section drawing of a wireless air tube headset according to an illustrative embodiment of the present invention. The partial section drawing of FIG. 11 illustrates the housing 180 having the acoustic chamber 184 with the acoustic transducer 186 disposed therein. The acoustic port 190 couples the acoustic chamber 184 to the exterior of the housing 180. An isolation means 182 encloses the back side of the acoustic transducer 186. A removable coupling 188 is attached to a first end of the acoustic conduit 192, and removably engages the acoustic port 190. In FIG. 11, the coupler 188 is disengaged from the port 190. The attachment between the removable coupler 188 and the acoustic port 190 can be by threaded engagement, bayonet coupling, friction fit, compression fit, or other sealable engagement means as are known to those skilled in the art. At the second end of the acoustic conduit 192, there is a second removable coupler 194 that removably engages the acoustic coupler 198. The second removable coupler 196 can also be by threaded engagement, bayonet coupling, friction fit, compression fit, or other sealable engagement means as are known to those skilled in the art. The earpiece 200 removably engages the acoustic coupler 200. Together, the foregoing components form a complete and sealed acoustic path from the acoustic transducer 186 to the earpiece 200.

Figure 12:
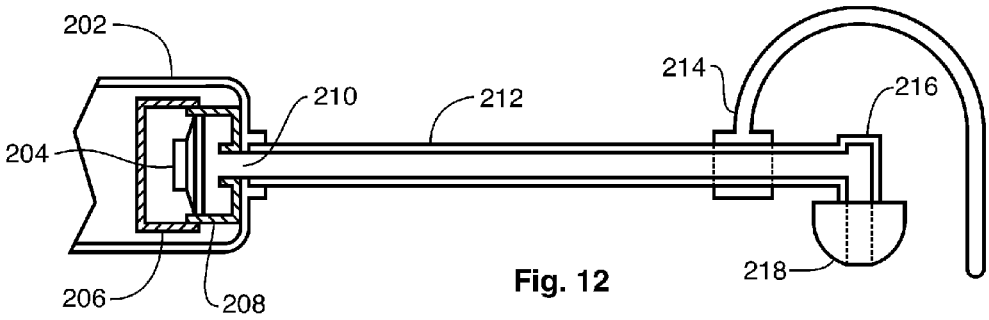
FIG. 12 is a partial section drawing of a wireless air tube headset according to an illustrative embodiment of the present invention.

Reference is directed to FIG. 12, which is a partial section drawing of a wireless air tube headset according to an illustrative embodiment of the present invention. The housing 202, acoustic transducer 204, acoustic chamber 208, isolation means 204, and acoustic port 210 are similar to those discussed with respect to FIG. 9. In FIG. 12, a non-conductive rigid pipe 212 is used as the acoustic conduit. A first end of the acoustic conduit us sealably coupled to the acoustic port 210. A second end of the acoustic conduit transitions into an acoustic coupler 216, which may be formed as a portion of a single complete unit. The essential aspect of the acoustic coupler 216 is that it engages the earpiece 218. An ear hook 214 is fixed to the acoustic conduit 212, which engages the user's ear to support the apparatus during use.

Figure 13:
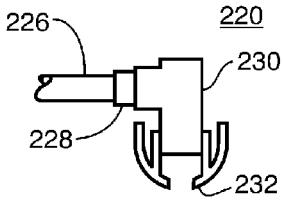
FIG. 13 is a partial section drawing of an earpiece for a wireless air tube headset according to an illustrative embodiment of the present invention.

Reference is directed to FIG. 13, which is a partial section drawing of an earpiece for a wireless air tube headset according to an illustrative embodiment of the present invention. The present invention contemplates a variety of earpiece types that are adapted to meet the needs of particular users. The illustrative embodiment employs an acoustic coupler that is adapted to connect the acoustic conduit to the earpiece, which may be removably connected thereto. In FIG. 13, and ear bud 232 earpiece is illustrated. An ear bud engages the canal of the user's ear to retain the earpiece in place. The ear bud 232 is fabricated from a resilient elastomeric material so that if can compressively engage the user's ear. The ear bud 232 engages the acoustic coupler 230 that couples the acoustic signals a right angle to the acoustic conduit 226. There is a removable coupling 228 between the acoustic conduit 226 and the acoustic coupler 230 in this embodiment.

Figure 14:
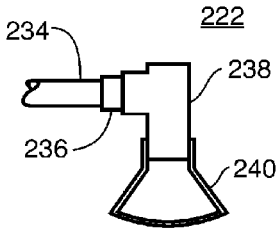
FIG. 14 is a partial section drawing of an earpiece for a wireless air tube headset according to an illustrative embodiment of the present invention.

Reference is directed to FIG. 14, which is a partial section drawing of an earpiece for a wireless air tube headset according to an illustrative embodiment of the present invention. In this illustrative embodiment, an ear phone 240 earpiece is adapted for use with the invention. The ear phone 240 is held in close proximity to the user's ear, and may support weight of the apparatus by resting against the outer ear, but does not compressively engage the ear. The ear phone 240 may be fabricated from a rigid material. The ear phone 240 engages the acoustic coupler 238 that couples the acoustic signals a right angle to the acoustic conduit 234. There is a removable coupling 236 between the acoustic conduit 234 and the acoustic coupler 238 in this embodiment.

Figure 15:
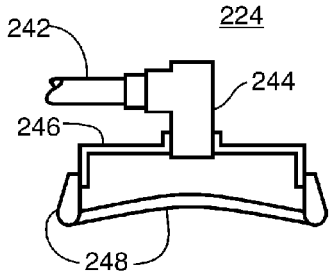
FIG. 15 is a partial section drawing of an earpiece for a wireless air tube headset according to an illustrative embodiment of the present invention.

Reference is directed to FIG. 15, which is a partial section drawing of an earpiece for a wireless air tube headset according to an illustrative embodiment of the present invention. In this illustrative embodiment, an ear cup 248 earpiece is adapted for use with the invention. The ear cup 248 is adapted to be held over the outer ear in supra-aural fashion, and is engaged with the acoustic coupler 244 using an adaptor plate 246. The ear cup 248 is particularly suitable for user who wear a hearing aid, or who feel discomfort by placing objects into their ear. The ear cup 248 does not hold itself in position and cannot support the weight of the apparatus, therefore, some other support member is required. The ear phone 248 may be fabricated from a rigid or pliable material. The ear cup 248, 246 engages the acoustic coupler 244 that couples the acoustic signals a right angle to the acoustic conduit 242. There is a removable coupling 244 between the acoustic conduit 242 and the acoustic coupler 244 in this embodiment.

Figure 16:
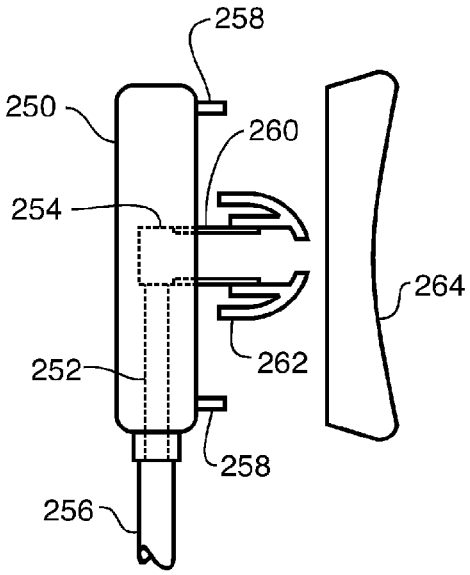
FIG. 16 is a side view drawing of an earpiece for a wireless air tube headset according to an illustrative embodiment of the present invention.
Figure 17:
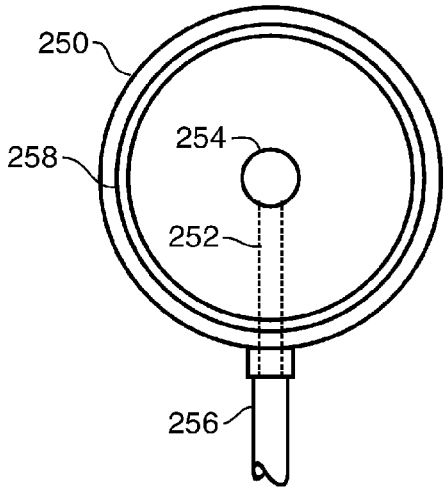
FIG. 17 is a front view drawing of an earpiece for a wireless air tube headset according to an illustrative embodiment of the present invention.
Figure 18:
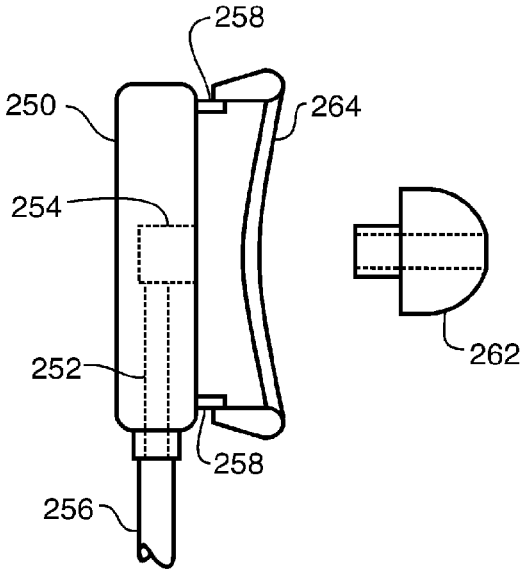
FIG. 18 is a diagram of the auricle portion of the human ear.

Reference is directed to FIG. 16, FIG. 17, and FIG. 18, which are a side view, front view, and alternate side view drawing of an earpiece for a wireless air tube headset according to an illustrative embodiment of the present invention. In this illustrative embodiment, the acoustic coupler 250 has a first opening 254 adapted to acoustically engage the acoustic conduit 256 in a manner similar to the previously discussed illustrative embodiments. The acoustic coupler 250 further includes a second opening 254 adapted to engage a first type of earpiece. In FIG. 16, and ear bud 262 earpiece is illustrated as being engaged with the second opening 254, while an alternate ear cup 264 is not engaged. This illustrative embodiment further includes a second means 258 for attaching an earpiece. This is an annular ring 258 that retains a removably connected ear cup 264. The annular ring 258 may engage the ear cup 264 by threadable engagement, by bayonet flanges, by friction, by compression, or by other means known to those skilled in the art. FIG. 18 illustrates the ear cup 264 engaged with the annular ring 258 while the ear bud 262 is removed. This arrangement enable the use of the apparatus in two modes, an ear supported mode employing the ear bud 262 as the support means, and a supra-aural mode utilizing the ear cup 264. The ear cup 264 is particularly well suited for use with a hearing aid since it does not approach the ear canal, and since there is no electrical circuitry nearby to interfere with the electrical operations and signals processed within the hearing aid.

Figure 19:
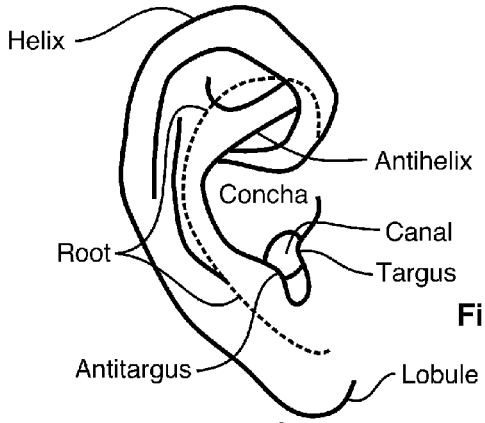
FIG. 19 is a drawing of an ear bud earpiece for a wireless air tube headset according to an illustrative embodiment of the present invention.

Reference is directed to FIG. 19, which is a diagram of the auricle portion of the human ear. The present invention contemplates various earpiece designs that are coupled by non-conductive structures and acoustic conduits to the circuit housing discussed hereinbefore. The various earpiece designs are intended to address the requirements and preferences of various users. In general, there is a need to route the acoustic signals to the area adjacent to the ear canal, a need to hold the earpiece in position at the ear, and a need to support the weight of the apparatus. The earpiece must address the first two requirements, and may address the third requirement. FIG. 19 illustrates the anatomical structure of the outer ear, referred to as the auricle. The upper portion of the auricle is the helix, which couples to the side of the head at the root of the ear. Sound passes to the eardrum through canal. The canal is coupled to the auricle by the funnel-shaped concha. The concha is bounded at the top and rear by the antihelix, and at the bottom by the targus toward the front ad the antitargus toward the rear. The lowest extent of the auricle is the lobule.

Figure 20:
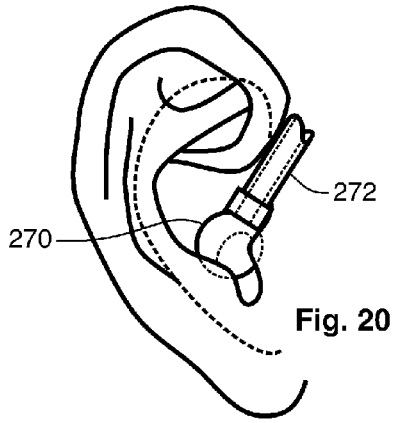
FIG. 20 is a drawing of an ear bud earpiece for a wireless air tube headset according to an illustrative embodiment of the present invention.

Reference is directed to FIG. 20, which is a drawing of an ear bud earpiece for a wireless air tube headset according to an illustrative embodiment of the present invention. An ear bud is characterized in that it is pressed into and supportively engages the ear canal. In this illustrative embodiment, the ear bud 270 is pressed into the ear canal and the acoustic conduit 272 is routed away.

Figure 21:
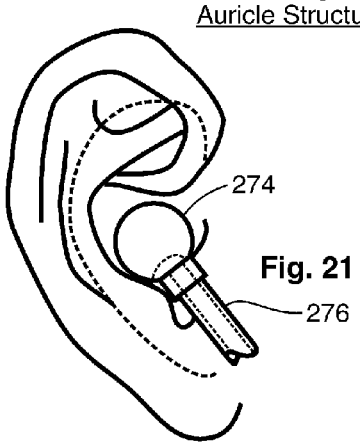
FIG. 21 is a drawing of an ear phone earpiece for a wireless air tube headset according to an illustrative embodiment of the present invention.

Reference is directed to FIG. 21, which is a drawing of an ear phone earpiece for a wireless air tube headset according to an illustrative embodiment of the present invention. An ear phone is characterized in that it is place in to or directly adjacent to the concha. It does not enter the canal, but it may hand from the targus and antitargus. In this illustrative embodiment, the ear phone 274 is positioned into the concha and the acoustic conduit 276 is routed away.

Figure 22:
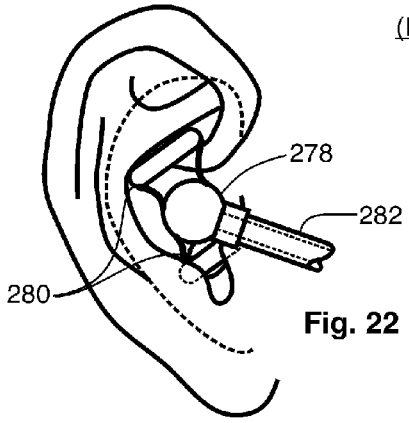
FIG. 22 is a drawing of an ear insert earpiece for a wireless air tube headset according to an illustrative embodiment of the present invention.

Reference is directed to FIG. 22, which is a drawing of an ear insert earpiece for a wireless air tube headset according to an illustrative embodiment of the present invention. An ear insert is similar to an ear phone in that the earpiece is inserted into the concha, but not the canal. In FIG. 22, the ear insert 278 emits the acoustic signals to the ear. The ear insert 278 is supported by a pair of flexible members 280 that engage the rim of the concha, including the antihelix, the targus, and the antitargus. An acoustic conduit 282 couples the acoustic signals to the ear insert 278.

Figure 23:
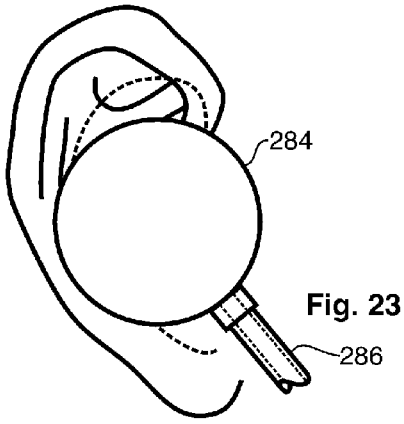
FIG. 23 is a drawing of an ear cup earpiece for a wireless air tube headset according to an illustrative embodiment of the present invention.

Reference is directed to FIG. 23, which is a drawing of an ear cup earpiece for a wireless air tube headset according to an illustrative embodiment of the present invention. An ear cup 284 is a supra-aural earpiece that is placed against the outer ear. The acoustic conduit 286 couples acoustic signals to the ear cup 284.

Figure 24:
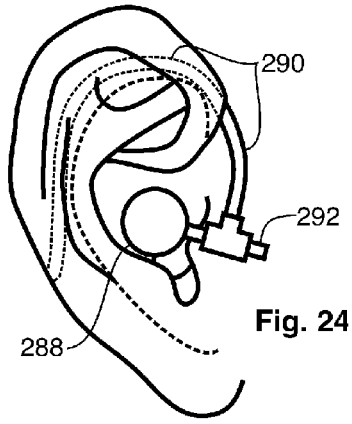
FIG. 24 is a drawing of an ear hook earpiece for a wireless air tube headset according to an illustrative embodiment of the present invention.

Reference is directed to FIG. 24, which is a drawing of an ear hook earpiece for a wireless air tube headset according to an illustrative embodiment of the present invention. Various earpieces 288 can be adapted for use with the ear hook 290. Acoustic signals are coupled to the earpiece 288 through an acoustic conduit 288. The ear hook 290 can connect to the earpiece 292, the acoustic conduit 292, or the acoustic coupler (not shown).

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A wireless air tube headset apparatus, comprising:

a wireless transceiver operable within a radio frequency band;

an acoustic chamber having an acoustic port formed there through to the exterior thereof;

an acoustic transducer electrically coupled to said transceiver and operable to generate acoustic signals, and aligned with said acoustic chamber to emit said acoustic signals through said acoustic port;

an acoustic isolator disposed to attenuate extraneous acoustic signals emitted from said acoustic transducer and attenuate ambient noise entry into said acoustic chamber;

an acoustic conduit formed from an electrically non-conductive material, and having a first opening engaged with said acoustic port and a second opening;

an acoustic coupler engaged with said second opening of said acoustic conduit, and having a first earpiece engagement means configured as an acoustic opening adapted to engage an ear bud earpiece;

a second earpiece engagement means disposed about said earpiece engagement means and adapted to engage an ear cup earpiece;

an earpiece engaged to said first earpiece engagement means, thereby forming an electrically non-conductive acoustic path from said acoustic transducer to said earpiece, and wherein said acoustic path has a length to enable displacement of said transceiver and said acoustic transducer from said earpiece at a distance sufficient to yield at least a six decibel radio signal propagation power loss at said radio frequency band.

2. The apparatus of claim 1, and wherein said acoustic conduit is a flexible tube.

3. The apparatus of claim 1, and wherein said acoustic conduit is a rigid pipe.

4. The apparatus of claim 1, and wherein said acoustic conduit is adapted to support the weight of the apparatus from said earpiece.

5. The apparatus of claim 1, and wherein
said acoustic conduit is formed into the shape of an ear hook for supporting the weight of the apparatus.

6. The apparatus of claim 1, and wherein
said acoustic port is sealably coupled to said acoustic conduit, and wherein
said acoustic conduit is sealably coupled to said acoustic coupler.

7. The apparatus of claim 1, and wherein
said first opening of said acoustic conduit is coupled to said acoustic port with a removable coupling.

8. The apparatus of claim 7, and wherein
said removable coupling employs a connection selected from a threaded engagement, a bayonet engagement, a compression engagement, and a friction engagement.

9. The apparatus of claim 1, and wherein
said acoustic coupler is engaged with said second opening of said acoustic conduit with a removable coupling.

10. The apparatus of claim 9, and wherein
said removable coupling employs a connection selected from a threaded engagement, a bayonet engagement, a compression engagement, and a friction engagement.

11. The apparatus of claim 1, and wherein
said second earpiece engagement means employs a connection selected from a threaded engagement, a bayonet engagement, a compression engagement, and a friction engagement.

12. The apparatus of claim 1, and wherein
said first earpiece engagement means is adapted to engage alternate earpiece types selected from an ear bud, an ear phone, an ear insert, and an ear cup.

13. The apparatus of claim 1, further comprising:
an ear hook coupled to support said earpiece and said acoustic coupler.

14. A wireless air tube headset apparatus, comprising:
a wireless transceiver operable within a radio frequency band;
an acoustic chamber having an acoustic port formed there through to the exterior thereof;
an acoustic transducer electrically coupled to said transceiver and operable to generate acoustic signals, and aligned with said acoustic chamber to emit said acoustic signals through said acoustic port;
an acoustic isolator disposed to attenuate extraneous acoustic signals emitted from said acoustic transducer and attenuate ambient noise entry into said acoustic chamber;
an acoustic conduit formed from an electrically non-conductive material, and having a first opening engaged with said acoustic port and a second opening;
an acoustic coupler engaged with said second opening of said acoustic conduit, and having a first earpiece engagement means;
an earpiece engaged to said first earpiece engagement means, thereby forming an electrically non-conductive acoustic path from said acoustic transducer to said earpiece, and wherein
said acoustic path has a length to enable displacement of said transceiver and said acoustic transducer from said earpiece at a distance sufficient to yield at least a six decibel radio signal propagation power loss at said radio frequency band;
a housing disposed about said sound chamber, and wherein
said acoustic port is accessible from the exterior of said housing, and wherein
said transceiver is disposed within said housing, and
an acoustic conduit storage member disposed on the exterior of said housing, and adapted to engage said acoustic conduit as it is wrapped there about.

15. The apparatus of claim 14, and wherein
said acoustic transducer includes a frame supporting a vibrating element, and said frame is sealably engaged with said acoustic chamber, thereby forming a closed acoustic chamber about said acoustic port.

16. The apparatus of claim 15, and wherein
said acoustic isolator includes a sealed cover about a portion of said acoustic transducer that is exterior to said closed acoustic chamber.

17. The apparatus of claim 14, further comprising:
an antenna electrically coupled to said transceiver and disposed within said housing;
a battery disposed within said housing for powering the apparatus, and
plural user interface controls electrically coupled to said transceiver and disposed about said housing.

18. The apparatus of claim 14, further comprising:
a microphone electrically coupled to said transceiver and disposed within said housing, and wherein
said acoustic isolator includes an elastomeric shock mount disposed to isolate said microphone from said acoustic signals.

19. The apparatus of claim 14, further comprising:
a vibrator disposed within said housing and electrically coupled to said transceiver, and adapted to produce a vibrating alert indicative of the availability of acoustic signals.

20. The apparatus of claim 14 adapted for support from a person, a person's clothing, or a personal accessory, the apparatus further comprising:
a support member disposed on the exterior of said housing for supporting the weight of the apparatus.

21. The apparatus of claim 20, and wherein
said support member is selected from a clip, a spring loaded clip, a lanyard ring, a pin, a friction attachment, and a hook.

22. The apparatus of claim 20, and wherein
said support member is adapted to engage the frame of a pair of eyeglasses.

23. The apparatus of claim 14, further comprising:
an earpiece engagement member adapted to engage said earpiece while said acoustic conduit is wrapped about said acoustic conduit storage member.

* * * * *